United States Patent [19]

Cheng

[11] Patent Number: 5,020,251

[45] Date of Patent: Jun. 4, 1991

[54] MULTI-LEVEL HOLDER OF SHEET MATERIALS

[76] Inventor: Peter S. C. Cheng, 5 Ross Street, Toronto, Ontario, Canada, M5T 1Z8

[21] Appl. No.: 495,430

[22] Filed: Mar. 19, 1990

[51] Int. Cl.[5] ..... A47G 1/06

[52] U.S. Cl. ..... 40/152.1; 40/152

[58] Field of Search ..... 40/152, 152.1, 156

[56] References Cited

U.S. PATENT DOCUMENTS

| | | | |
|---|---|---|---|
| 3,371,439 | 3/1968 | Smith | 40/152 |
| 3,722,122 | 3/1973 | Sesto | 40/152 |
| 4,034,496 | 7/1977 | Cohen | 40/152 |
| 4,211,022 | 7/1980 | Angelakos | 40/156 |
| 4,441,268 | 4/1984 | Scott | 40/156 |
| 4,532,727 | 8/1985 | Klose | 40/152 |
| 4,779,368 | 10/1988 | Thede | 40/156 |
| 4,830,404 | 5/1989 | Lu | 40/152 |

*Primary Examiner*—Gary L. Smith
*Assistant Examiner*—F. Saether
*Attorney, Agent, or Firm*—Kirschstein, Ottinger, Israel & Schiffmiller

[57] ABSTRACT

A bi-partite holder supportably displays multiple photographs in a multi-planar arrangement, and includes multi-level backing and cover members between which the photographs are clampingly held for display.

15 Claims, 2 Drawing Sheets

MULTI-LEVEL HOLDER OF SHEET MATERIALS

BACKGROUND OF THE INVENTION

1. Field of the Invention

This invention generally relates to sheet material holders and, more particularly, to a multi-level holder for supportably displaying multiple pictures, photographs and like sheet materials in a multi-level arrangement.

2. Description of Related Art

Many different types of picture frames had holders for holding and displaying objects such as photographs have been proposed in the art. For example, see U.S. Pat. Nos. 4,034,496; 4,123,862; 4,017,989; 3,813,799 and 3,722,122.

When it is desired to display more than one photograph at a time in the same plane, the known picture frames and holders, for example, see U.S. Pat. No. 4,017,989, have tended to become relatively complicated in design and expensive in construction. Specially designed connectors and individual mounting frames are required. It is often difficult to position the photographs in and/or to remove the photographs from the known picture frames without resorting to an extensive disassembly and reassembly procedure.

When it is desired to display photographs in different planes, for example, see U.S. Pat. No. 4,034,496, the known holders do not provide means for reliably keeping dust, dirt and other contaminants from the photographs. Nor do the known holders reliably press flat the entire surface of the photographs for preventing their curling over time. Curled and soiled photographs do not make for an attractive display.

SUMMARY OF THE INVENTION

1. Objects of the Invention

It is a general object of this invention to attractively display multiple sheet materials such as photographs in a multi-level arrangement.

It is another object of this invention to display multiple photographs with a striking three-dimensional visual effect.

Another object of this invention is to prevent curling and soiling of multiple photographs on display.

A further object of this invention is to avoid extensive disassembly and reassembly procedures when mounting or changing photographs.

An additional object of this invention is to provide a novel picture holder of only two parts.

Yet another object of this invention is to provide a novel picture holder which is simple in design, inexpensive to manufacture, and esthetically pleasing.

2. Features of the Invention

In keeping with these objects, and others which will become apparent hereinafter, one feature of this invention resides, briefly stated, in a multilevel holder for supportably displaying multiple sheet materials such as pictures, photographs, negatives, art work, decorative flat objects, cards, and the like, in a multi- level arrangement.

The holder may have only two parts. The first part is a backing member having a plurality of curved or generally planar, non-overlapping back supports arranged in a predetermined pattern. At least some of the back supports, if not all, lie at different levels relative to one another. Preferably, the backing member has a stepped cross-section.

The second part is a cover member having a corresponding plurality of curved or generally planar non-over-lapping cover supports arranged in the same predetermined pattern. At least some of the covered supports, if not all, lie at different levels relative to one another. The cover member preferably has a stepped cross-section.

The cover member is mounted on the backing member and assumes an assembled condition. The cover supports are mounted over, and at a spacing from, the back supports. Each back support and overlying cover support together press and clampingly hold a sheet material in a respective spacing. The cover supports are light-transmissive to enable viewing therethrough of the pressed sheet materials held in said multi-level arrangement.

In a preferred embodiment, the backing member has a plurality of back walls or steps, each extending generally perpendicularly of adjacent back supports. The cover member also has a plurality of cover walls or ledges, each extending generally perpendicularly of adjacent cover supports. The cover walls engage the back walls in the assembled condition.

The cover member has a peripheral border flange which frictionally engages the backing member, preferably with a friction fit, in the assembled condition.

The holder can be mounted on either a vertical wall or a horizontal support surface. The backing member is preferably fabricated of an opaque, synthetic plastic material, whereas, the cover member is preferably fabricated of a transparent synthetic plastic material. The cover member may be formed of one or more sections interfitted with one another in the assembled condition.

The multi-level holder according to this invention thus avoids extensive disassembly and reassembly procedures when mounting or changing photographs. Multiple photographs are displayed in a multi-level arrangement having a striking three-dimensional visual effect while reliably preventing curling and soiling of the individual photographs on display. The holder is simple in design, inexpensive to manufacture, and esthetically pleasing.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
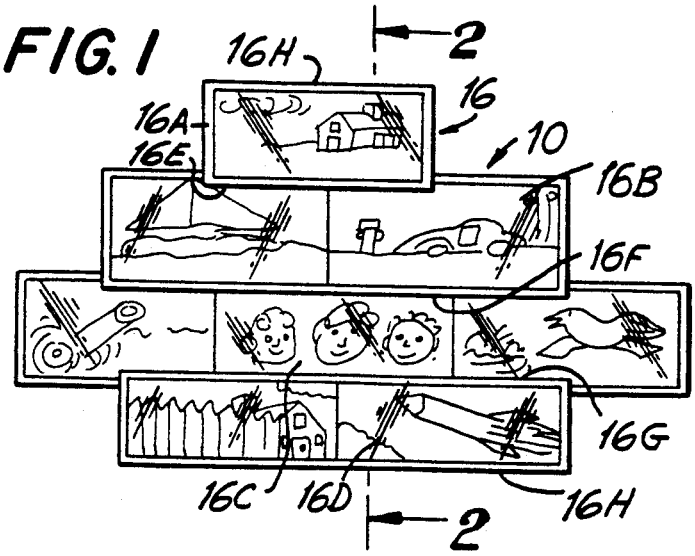
FIG. 1 is a front view of a bi-partite holder according to the present invention.

Referring now to the drawings, reference numeral 10 in FIG. 1 generally identifies a bi-partite holder for supportably displaying multiple sheet materials 12 in a multi-planar arrangement. The sheet materials may be pictures, photographs, negatives, cards, decorative flat objects, and the like.

Figure 2:
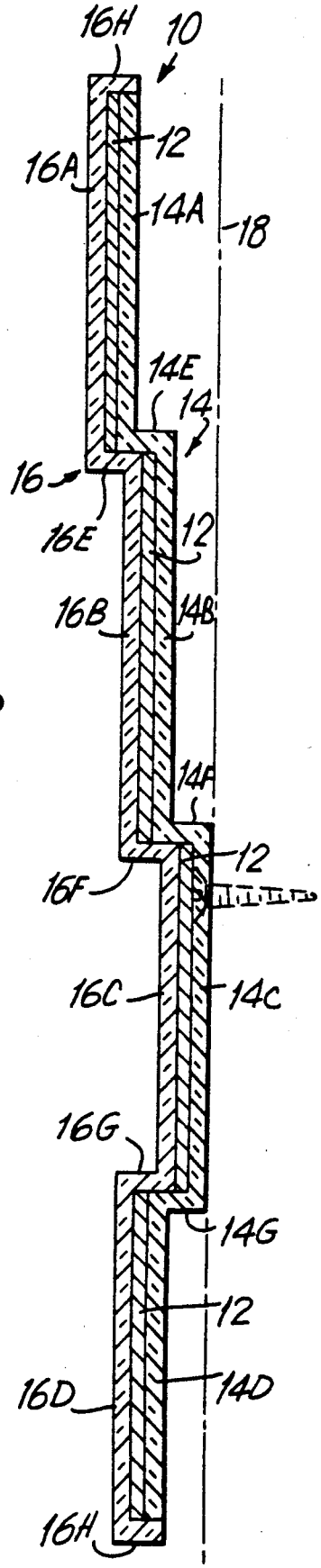
FIG. 2 is an enlarged sectional view taken on line 2—2 of FIG. 1, showing the holder mounted on a vertical wall.

As best shown in FIG. 2, the holder 10 comprises two parts: a backing member 14 and a cover member 16. The sheet materials 12 are pressed and clampingly held between the backing and cover members, as explained in detail below, in the assembled condition shown in FIG. 2.

The backing member 14 has a stepped cross-section, and includes a plurality of generally planar, non-overlapping back supports 14A, 14B, 14C, 14D arranged in a predetermined pattern. For example, as shown in FIG. 1, the back supports are generally rectangular, and are stacked one above another in staggered rows, at least some of the rows having different numbers of the back supports. Virtually any pattern of back supports is contemplated by this invention. This invention is not intended to be limited to rectangular back supports, since each may have any geometric shape. At least some of the back supports, for example, 14A, 14B, 14C, lie in different planes in mutual parallelism. Back support 14D is the only illustrated exception, and is co-planar with back support 14A.

The backing member 14 also has a plurality of back walls or steps 14E, 14F, 14G, each extending generally perpendicularly of adjacent back supports.

The cover member 16 has a stepped cross-section and a corresponding plurality of generally planar, non-overlapping cover supports 16A, 16B, 16C, 16D, arranged in the same predetermined pattern as the back supports of the backing member. At least some of the cover supports 16A, 16B, 16C lie in different planes in mutual parallelism. Cover support 16D is the only exception, and is co-planar with back support 16A.

The cover member 16 also has a plurality of cover walls or ledges 16D, 16F, 16G, each extending generally perpendicularly of adjacent cover supports. The cover member further has a peripheral border flange 16H. The border flange frictionally engages a peripheral edge of the backing member 12 in the assembled condition.

The cover member is mounted on the backing member in the assembled condition illustrated in FIG. 2. The cover supports are mounted over, and at a spacing from, the back supports Each back support and overlying cover support together press and clampingly hold a sheet material 12 in a respective spacing. The ledges 16E, 16F, 16G frictionally engage the steps 14E, 14F, 14G, respectively, in the assembled condition. The lengths of each corresponding pair of steps and ledges are the same.

The cover supports are light-transmissive to enable viewing therethrough of the pressed sheet materials held in the multi-planar arrangement. Advantageously, the cover supports, as well as the entire cover member, are constituted of a transparent, synthetic plastic material. The backing member is also fabricated of a synthetic plastic material, and advantageously is opaque.

Figure 3:
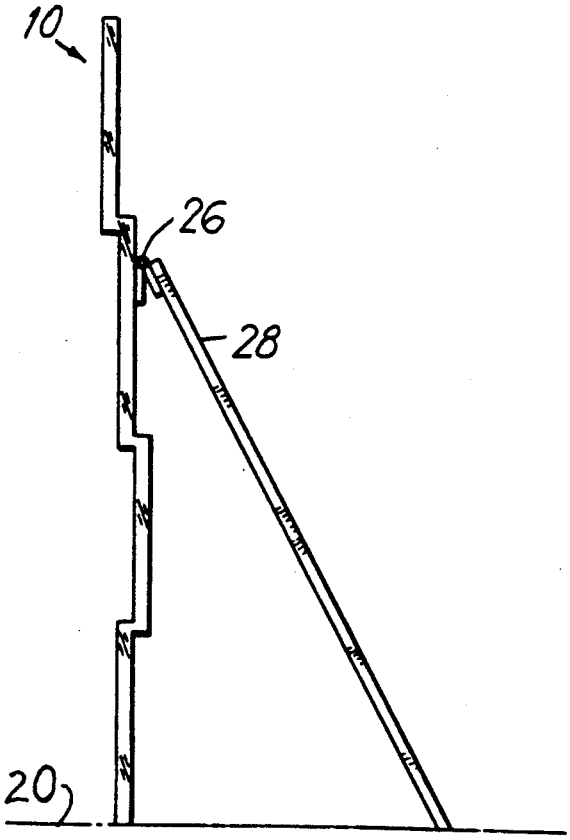
FIG. 3 is a reduced side view of another holder shown mounted on a horizontal support surface.

The bi-partite holder 10 can be mounted on a vertical wall 18 (FIG. 2) or on a horizontal support surface 20 (FIG. 3). A mounting hole 22 can be formed in a rearmost back support, and the head of a fastener, such as a nail 24, can be inserted into the mounting hole to support the holder in a generally vertical orientation.

Alternately, a hinge 26 can be mounted at the rearmost back support. One arm of the hinge is connected to the rearmost back support, whereas, the other arm is connected to an inclined rear flap 28. The flap serves to support the holder 10 in a generally vertical orientation on a horizontal countertop or like support surface.

In order to mount or change one or some of the sheet materials, it is merely necessary to pull the cover member 16 off the backing member 14, thereby simultaneously exposing all of the sheet materials and gaining ready access to any one or more of the latter. Once the sheet material(s) have been mounted, it is merely necessary to push the cover member back onto the backing member, thereby simultaneously pressing flat all of the sheet materials.

The multi-level cover member reliably prevents dust, dirt and other contaminants from reaching all of the sheet materials, as well as preventing curling of the sheet materials over time. It is simple and easy to replace the sheet materials without resorting the extensive assembly and disassembly procedures.

Figure 4:
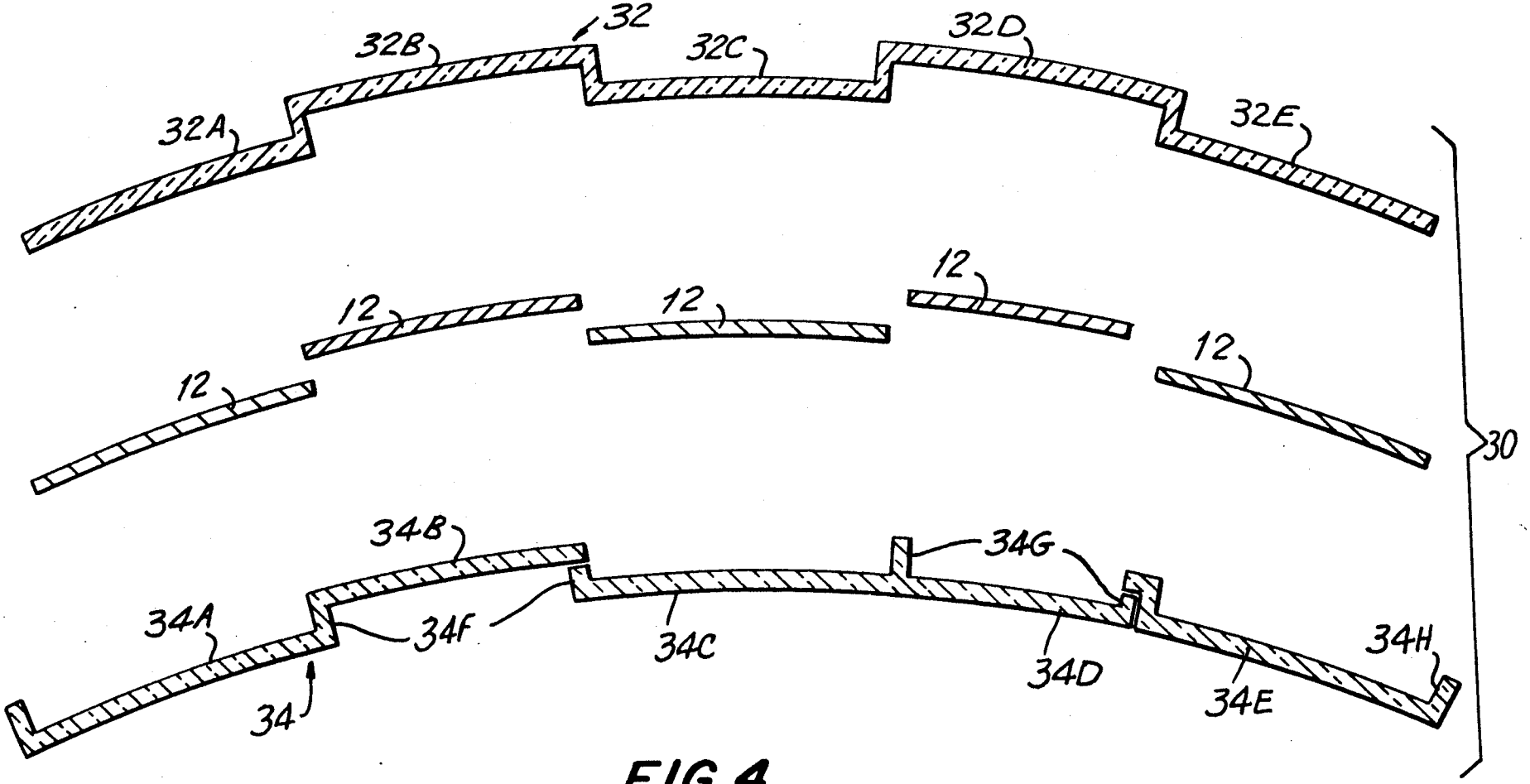
FIG. 4 is a top, exploded view of a modified holder according to the present invention.

Turning now to FIG. 4, the holder need not generally lie in a flat plane, but may be concavely curved. The curved holder 30 has a backing member 32 having a plurality of concavely curved back supports 32A–32E lying along an arc having a common center of curvature, as well as a cover member 34 having a plurality of concavely curved cover supports 34A–34E lying along a concentric arc having the same common center of curvature. The back supports lie at different relative levels due to radial steps 32F, 32G. The cover supports lie at different relative levels due to radial steps 34F, 34G. The cover member also has a peripheral border flange 34H.

In the assembled condition, the curved cover supports overlie the curved back supports and together press and clampingly hold sheet materials 12 in spacings therebetween, as described above.

The cover member 34 need not be fabricated as a single member, but may be constituted of more than one member interfitted together. As shown in FIG. 4, the cover member 34 has three interfitting parts. Analogously, the cover member 16 of FIGS. 1–3 may be constituted of a set of interfitting members.

It will be understood that each of the elements described above, or two or more together, also may find a useful application in other types of constructions differing from the types described above.

While the invention has been illustrated and described as embodied in a bi-partite holder of sheet materials, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the general or specific aspects of this invention and, therefore, such adaptations should and are intended to be comprehended within the meaning and range of equivalence of the following claims.

What is claimed as new and desired to be protected by Letters Patent is set forth in the appended claims.

1. A holder for supportably displaying multiple sheet materials in a three-dimensional arrangement, comprising:

(a) a backing member having a plurality of non-overlapping back supports arranged in a predetermined pattern of rows, each extending along a first direction, said rows being stacked one above another along a second direction generally perpendicular to the first direction, some of the back supports lying at different levels as considered along a third viewing direction generally perpendicular to the first and second directions, said backing member having stepped outer and inner surfaces respectively facing away and toward the sheet materials to be displayed;

(b) a cover member having a corresponding plurality of non-overlapping cover supports arranged in the same predetermined pattern, some of the cover support lying at different levels as considered along the third viewing direction, said cover member having stepped outer and inner surfaces respectively facing away and toward the sheet materials to be displayed;

(c) means for mounting the cover member on the backing member in an assembled condition, and for mounting the cover supports over, and at a spacing from, the back supports, each back support and cover support mounted thereover together pressing and clampingly holding a respective sheet material in a respective spacing between the stepped inner surfaces of the backing and cover members; and (d) said cover supports being light-transmissive to enable viewing therethrough of the pressed sheet materials held in said three-dimensional arrangement.

2. The holder according to claim 1, wherein the backing member and the cover member are the sole parts of the holder to constitute a bi-partite holder.

3. The holder according to claim 1, wherein the back supports and the cover supports are generally planar, and wherein said some of the back supports and said some cover supports lie in different planes in mutual parallelism.

4. The holder according to claim 1, wherein the back supports and the cover supports are concavely curved.

5. The holder according to claim 1, wherein the cover member includes a plurality of cover sections interfitted with one another in the assembled condition.

6. The holder according to claim 3, wherein the backing member and the cover member each has a stepped cross-section; and wherein the backing member has a plurality of back walls, each extending generally perpendicularly of adjacent back supports; and wherein the cover member has a plurality of cover walls, each extending generally perpendicularly of adjacent cover supports; and wherein the cover walls frictionally engage the back walls in the assembled condition.

7. The holder according to claim 6, wherein at least one of the backwalls and one of the cover walls have the same length.

8. The holder according to claim 1, wherein the cover member has a peripheral border flange frictionally engaging the backing member in the assembled condition.

9. The holder according to claim 1, and further comprising means for mounting the holder on a support surface.

10. The holder according to claim 1, wherein the support surface is a vertical wall.

11. The holder according to claim 9, wherein the support surface is a horizontal surface.

12. The holder according to claim 1, wherein the backing member is opaque.

13. The holder according to claim 1, wherein the cover member is a transparent, synthetic plastic material.

14. A bi-partite holder for supportably displaying multiple sheet material in a three-dimensional arrangement, comprising:

(a) a backing member having a plurality of generally planar, non-overlapping, back supports arranged in a predetermined pattern of rows, each extending along a first direction, said rows being stacked one above another along a second direction generally perpendicular to the first direction, some of the back supports lying in different planes in mutual parallelism as considered along a third viewing direction generally perpendicular to the first and second directions, said backing member having stepped outer and inner surfaces respectively facing away and toward the sheet materials to be displayed;

(b) a cover member having a corresponding plurality of generally planar, non-overlapping, cover supports arranged in the same predetermined pattern, some of the cover supports lying in different planes in mutual parallelism as considered along the third viewing direction, said cover members having stepped outer and inner surfaces respectively facing away and toward the sheet materials to be displayed;

(c) means for mounting the cover member in the backing member in an assembled condition, and for mounting the cover supports over, and at a spacing from, the back supports, each back support and cover support mounted thereover together pressing and clampingly holding a respective sheet material in a respective spacing between the stepped inner surfaces of the backing and cover members; and (d) said cover supports being light-transmissive to enable viewing therethrough of the pressed sheet materials held in said three-dimensional arrangement.

15. A bi-partite holder for supportably displaying multiple sheet materials in a three-dimensional arrangement, comprising:

(a) a backing member having a plurality of concavely curved, non-overlapping, back supports arranged in a predetermined pattern of rows, each extending along a first direction, said rows being stacked one above another along a second direction generally perpendicular to the first direction and having a common center of curvature, some of the back supports lying at different levels relative to the center of curvature as considered along a third viewing direction generally perpendicular to the first and second directions, said backing member having stepped outer and inner surfaces respectively facing away and toward the sheet materials to be displayed;

(b) a cover member having a corresponding plurality of concavely curved, non-overlapping, cover supports arranged in the same predetermined pattern and at said same center of curvature, some of the cover supports lying at different levels relative to the center of curvature as considered along the third viewing direction, said cover member having stepped outer and inner surfaces respectively facing away and toward the sheet materials to be displayed;

(c) means for mounting the cover member on the backing member in an assembled condition, and for mounting the cover supports over, and at a spacing from, the back supports, each back support and cover support mounted thereover together pressing and clampingly holding a respective sheet material in a respective spacing between the stepped inner surfaces of the backing and cover members; and (d) said cover supports being light-transmissive to enable viewing therethrough of the pressed sheet materials held in said three-dimensional arrangement.

* * * * *